US005555631A

United States Patent [19]

Houston

[11] Patent Number: 5,555,631

[45] Date of Patent: Sep. 17, 1996

[54] ELLIPSE SCRIBE

[76] Inventor: Daniel J. Houston, P.O. Box 6713, Hilton Head Island, S.C. 29938

[21] Appl. No.: 373,101

[22] Filed: Jan. 17, 1995

[51] Int. Cl.[6] ..... B43L 11/055; B43L 9/04

[52] U.S. Cl. ..... 33/31; 33/27.032

[58] Field of Search ..... 33/31, 30.2, 30.6, 33/27.03, 27.032

[56] References Cited

U.S. PATENT DOCUMENTS

| | | | |
|---|---|---|---|
| 235,543 | 12/1880 | Lundqvist | 33/31 |
| 932,768 | 8/1909 | Dexter | 33/31 |
| 973,047 | 10/1911 | Jeter | 33/31 |
| 1,010,292 | 11/1911 | McKinstry | 33/31 |
| 1,021,583 | 3/1912 | Dzierwa | 33/31 |
| 2,452,484 | 10/1948 | Noble | 33/31 |
| 2,863,218 | 12/1958 | Weaver | 33/31 |
| 2,925,655 | 2/1960 | Beek | 33/31 |
| 3,808,691 | 5/1974 | Chase . | |
| 4,306,598 | 12/1981 | Peot | 33/31 |
| 4,407,074 | 10/1983 | Ledbetter . | |
| 5,058,282 | 10/1991 | Coll . | |
| 5,414,938 | 5/1995 | Meek | 33/456 |

FOREIGN PATENT DOCUMENTS

| | | | |
|---|---|---|---|
| 170206 | 10/1921 | United Kingdom | 33/31 |
| 2226530 | 7/1990 | United Kingdom | 33/31 |

*Primary Examiner*—Thomas B. Will
*Attorney, Agent, or Firm*—DeWitt Ross & Stevens SC

[57] ABSTRACT

An ellipse scribe for writing or cutting an ellipse onto or into a workpiece. Two perpendicular tracks each include a slider block which is capable of reciprocating within the tracks. The slider blocks are rotatably affixed at different points along the length of a scribe beam with a cursor mounted at one end of the scribe beam. The cursor scribes out an ellipse as the slider blocks reciprocate through a full cycle of motion. The size of the ellipse may be changed by disengaging the slider blocks from the scribe beam and translating the slider blocks within an adjustment track on the scribe beam to different points on the scribe beam. The scribe beam includes a removable scale whereby the locations of the slider blocks along the scribe beam may be determined, allowing the size of the ellipse to be accurately set.

20 Claims, 7 Drawing Sheets

ELLIPSE SCRIBE

FIELD OF THE INVENTION

The present invention relates generally to an ellipse scribe for scribing an ellipse upon a workpiece. More particularly, the present invention relates to an contact ellipse scribe which rests atop the workpiece.

BACKGROUND OF THE INVENTION

Craftsmen often need to mark or cut an elliptical shape into a workpiece. However, a true elliptical shape is difficult to inscribe and cut without the use of apparatus which assist in such inscription. Such apparatuses, generally designated "ellipse scribes," provide mechanical means whereby the craftsman may inscribe an elliptical shape into a workpiece.

Ellipse scribes are generally of two types. The first is an overhead ellipse scribe, illustrated in U.S. Pat. No. 3,808,691 to Chase. A swinging beam with a cursor at its end rests over the workpiece. The beam moves in an elliptical path over the workpiece and the cursor inscribes the ellipse thereupon. These ellipse scribes have the advantage that their components generally do not contact the workpiece, save for the cursor which performs the inscription, so the craftsman has an unobstructed view of the workpiece. However, overhead ellipse scribes also have the disadvantage that they must be of very great size if large ellipses are to be scribed. Thus, overhead ellipse scribes are impractical for the inscription of very large ellipses, such as those needed for elliptical tabletops.

The second common type of ellipse scribe is the contact or reciprocating beam ellipse scribe, as illustrated in U.S. Pat. No. 5,038,282 to Coll. These ellipse scribes utilize a beam having two pivotally mounted slides located thereupon, separated from each other by a distance. The slides reciprocate along mutually perpendicular tracks. As the slides reciprocate through a full cycle of motion, points along the beam follow an elliptical path, and thus a cursor mounted thereupon will scribe an ellipse. A cursor at one end of the beam (hereinafter the "scribe end") will inscribe an ellipse having a major axis radius equal to the distance between the cursor and the slide located the furthest away from the cursor, and a minor axis radius equal to the distance between the cursor and the slide located the nearest to the cursor. Coll's ellipse scribe includes a beam comprising two slidably attached ruled scales with a cursor slidably attached to the beam at the scribe end. Each scale within the beam includes a slide which is pivotally and slidably engaged to a respective track, with each track aligned perpendicularly to the other. As the slide of each scale traverses the entire track and returns to its starting point, the cursor sweeps out the ellipse. The scales may be repositioned with respect to one another within the beam so that the distances between their slides and the cursor may be reset, thereby altering the size of the ellipse to be scribed. The cursor may also be repositioned along the beam to alter the size of the ellipse.

While reciprocating beam ellipse scribes generally function in an acceptable manner, they have several disadvantages that the prior art fails to sufficiently address.

First, a reciprocating beam ellipse scribe must rest atop the workpiece upon which it will inscribe the ellipse. This can cause difficulties with the inscription of the ellipse because the tracks may intersect the elliptical path of the cursor, thereby requiring that the cursor be lifted over the tracks when they are encountered. Further, the center of the ellipse can be difficult to locate precisely when the ellipse scribe rests atop it.

Second, while the prior art discloses reciprocating beam ellipse scribes which include one or more scales for setting and measuring the axes of the ellipse to be inscribed, such scales tend to be difficult for novice craftsmen to understand and set correctly. This is because these scales generally include indicia indicating the length of either a major diameter, a minor diameter, a major radius, or a minor radius (or several of these). One who has never (or rarely) used an ellipse scribe before generally has difficulty determining whether he is setting the size of the diameter or the radius of the ellipse, and whether he is setting this parameter on a major or minor axis. Multiple scales help to compound the confusion. In addition, prior art ellipse scribes tend to have the scales integrally built into the apparatus, requiring the craftsman to use the mandated scale system (e.g. either a metric- or English-based scale which sets either the diameter or the radius of the ellipse) unless he wishes to endure the inconvenience of somehow modifying the ellipse scribe to use a customized scale.

Third, prior art ellipse scribes tend to be poorly designed for use with cutting equipment. Most tend to be designed for inscribing an ellipse on a workpiece using a cursor such as a pencil, rather than actually cutting the ellipse into the workpiece. These ellipse scribes adopt the notion that the craftsman can later use a power tool to cut out the inscribed ellipse. This frequently provides only a makeshift means for cutting a proper ellipse for a reason which unfortunately tends to become clear only after cutting of the inscribed ellipse on the workpiece has begun: it is generally extremely difficult to make high-horsepower cutting tools follow an inscribed elliptical path with high precision. Many cutting tools are intentionally or unintentionally designed to perform at their best when they cut along a straight path, making it difficult to force them to cut accurately along an elliptical path. In addition, with the size and configuration of many cutting tools, it can be difficult to even see such an inscribed path beneath the tool. Even where tools are designed so that a craftsman can see an inscribed line beneath the cutterhead, the cutterhead may be so large that precise alignment of the center of the cutterhead with the inscribed line is difficult. As an example, the wide cutterhead of a router can easily follow a thin inscribed line. However, the cut workpiece then tends to have a bumpy cut edge, since the cutterhead can waver laterally across the inscribed path while still remaining generally faithful to this path.

Fourth, the prior art ellipse scribes are too flimsy for practical use with power tools. As discussed above, they are primarily designed to support cursor means for writing ellipses on workpieces, rather than cutting an ellipse into a workpiece. Since such cursor means for writing are almost invariably lighter than cursor means for cutting, the ellipse scribes of the prior art are built with correspondingly lighter overall structure. As a result, these ellipse scribes do not have the structural integrity to support powerful cutting tools due to the weight of such tools. If such cutting tools are used with a prior art ellipse scribe, either the ellipse scribe collapses entirely, or the beam of the ellipse scribe tends to buckle, bend, and finally collapse.

This especially tends to be the case with prior art ellipse scribes that are sized to cut large ellipses, since their structures utilize long beams which have a greater tendency for buckling. Thus, the larger the ellipse to be cut, the greater the risk that the ellipse scribe will be destroyed during use.

Further, even while some prior art ellipse scribes can support extremely light cutting tools, e.g. portable, batterypowered hand tools, they still tend to lead to unsatisfactory results.

Initially, the use of light cutting tools, while possibly sufficient to cut ellipses from paper or thin wood or plastic, is totally inadequate for cutting ellipses from thicker or harder materials.

In addition, the structural integrity of the ellipse scribe still tends to be a problem. While the beam of the ellipse scribe may seem to adequately support a light cutting tool when the tool is at rest, problems arise when the tool is actually put to use. Cutting tools tend to generate tensile and compressive forces along the beam as the cutting forces generated by the interaction of the tool and the workpiece push and pull at the scribe end. This in turn leads to distortion in the beam and correspondingly distorted ellipses. This effect is especially apparent with cutting tools that cut at their best along a straight line. Since such cutting tools naturally resist following an elliptical path, they tend to cause the beam to bow upward and downward as they are moved along an elliptical path. This effect is also especially common in ellipse scribes with longer beams, i.e. those designed to cut larger ellipses.

The cutting forces generated by the cutting tool have an additional effect. The pushing and pulling of the cutting tool on the beam can generate shear forces of high magnitude at points along the beam. Most prior art ellipse scribes quickly or eventually break under these forces. Also, the shear forces can cause slippage in the mechanism that fixes the ellipse size. Thus, while the ellipse is being cut, the elliptical path can suddenly grow in size, and an elliptical spiral is cut instead. This slippage effect can be dangerous and also quite expensive, e.g. where the slippage causes a large workpiece to be cut improperly. This slippage effect is also common in prior art ellipse scribes because they have poor vibration damping properties, and therefore the vibrations from the cutting tool shake the size-fixing mechanism until it gradually slips.

SUMMARY OF THE INVENTION

The present invention is directed to a contact beam ellipse scribe which comprises a first track and a second track oriented perpendicularly to the first track and intersecting the first track at a centerpoint; a scribe beam including an elongated beam element with a scribe end and an adjustment track located on and substantially parallel to the elongated beam element; a first adjustment pin which slidably engages the adjustment track and which includes first slider means for slidably and rotatably engaging the first track; and a second adjustment pin which slidably engages the adjustment track and which includes second slider means for slidably and rotatably engaging the second track.

The present invention is also directed to a contact beam ellipse scribe including a first track and a second track oriented perpendicularly to the first track and intersecting the first track at a centerpoint; a first slider block slidably engaging the first track; a second slider block slidably engaging the second track; a scribe beam including a length with a scribe end at one end of the length and also including an adjustment track located upon and parallel to the length; a first adjustment pin rotatably connected to the first slider block and located within the adjustment track so as to be slidably connected to the scribe beam; first fixture means for affixing the first adjustment pin to the scribe beam in such a manner as to prevent sliding of the first adjustment pin with respect to the scribe beam; a second adjustment pin rotatably connected to the second slider block and located within the adjustment track so as to be slidably connected to the scribe beam; and second fixture means for affixing the second adjustment pin to the scribe beam in such a manner as to prevent sliding of the second adjustment pin with respect to the scribe beam.

The present invention is further directed to a contact beam ellipse scribe including a first keyway, a second keyway which intersects the first keyway and which is oriented substantially perpendicularly to the first keyway, a first slider block adapted to fit and slide within the first keyway, a second slider block adapted to fit and slide within the second keyway, a scribe beam including an elongated beam element with an adjustment track in the form of an elongated slot located thereupon, a first adjustment pin rotatably connected to the first slider block and translatably resting within the adjustment track, first fixture means for affixing the first adjustment pin to the scribe beam, a second adjustment pin rotatably connected to the second slider block and translatably resting within the adjustment track, and second fixture means for affixing the second adjustment pin to the scribe beam.

The present invention has several advantages over the prior art. First, the ellipse scribe of the present invention utilizes modular tracks to allow very large ellipses to be scribed without interfering with the tracks. Second, it uses a removable and replaceable scale to indicate the major and minor diameter and/or the radius of the ellipse to be scribed. Third, while the ellipse scribe may accommodate cursor means for drawing ellipses, it is specially designed to accommodate powerful cutting tools for accurately cutting exact ellipses in even very thick workpieces. The ellipse scribe allows the use of these cutting tools during the operation of the ellipse scribe without any slippage in the mechanism that sets the size of the ellipse or similar distortion-causing effects.

The objects and advantages of the invention will appear more fully from the following detailed description of the preferred embodiment of the invention made in conjunction with the accompanying drawings.

DETAILED DESCRIPTION OF THE INVENTION

Figure 1:
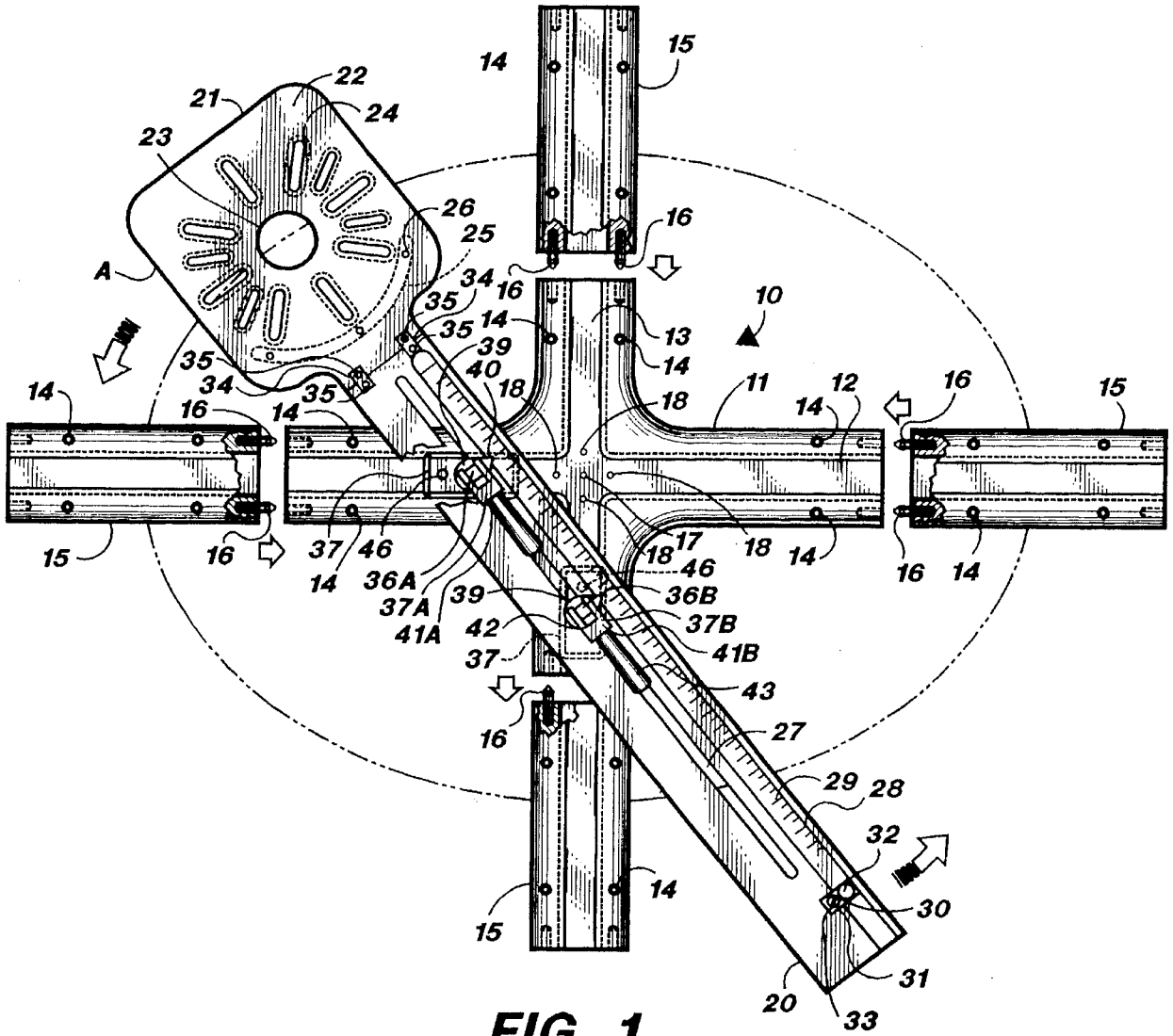
FIG. 1 is a top plan view of the ellipse scribe of the present invention with the scribe arm shown at position A.
Figure 2:
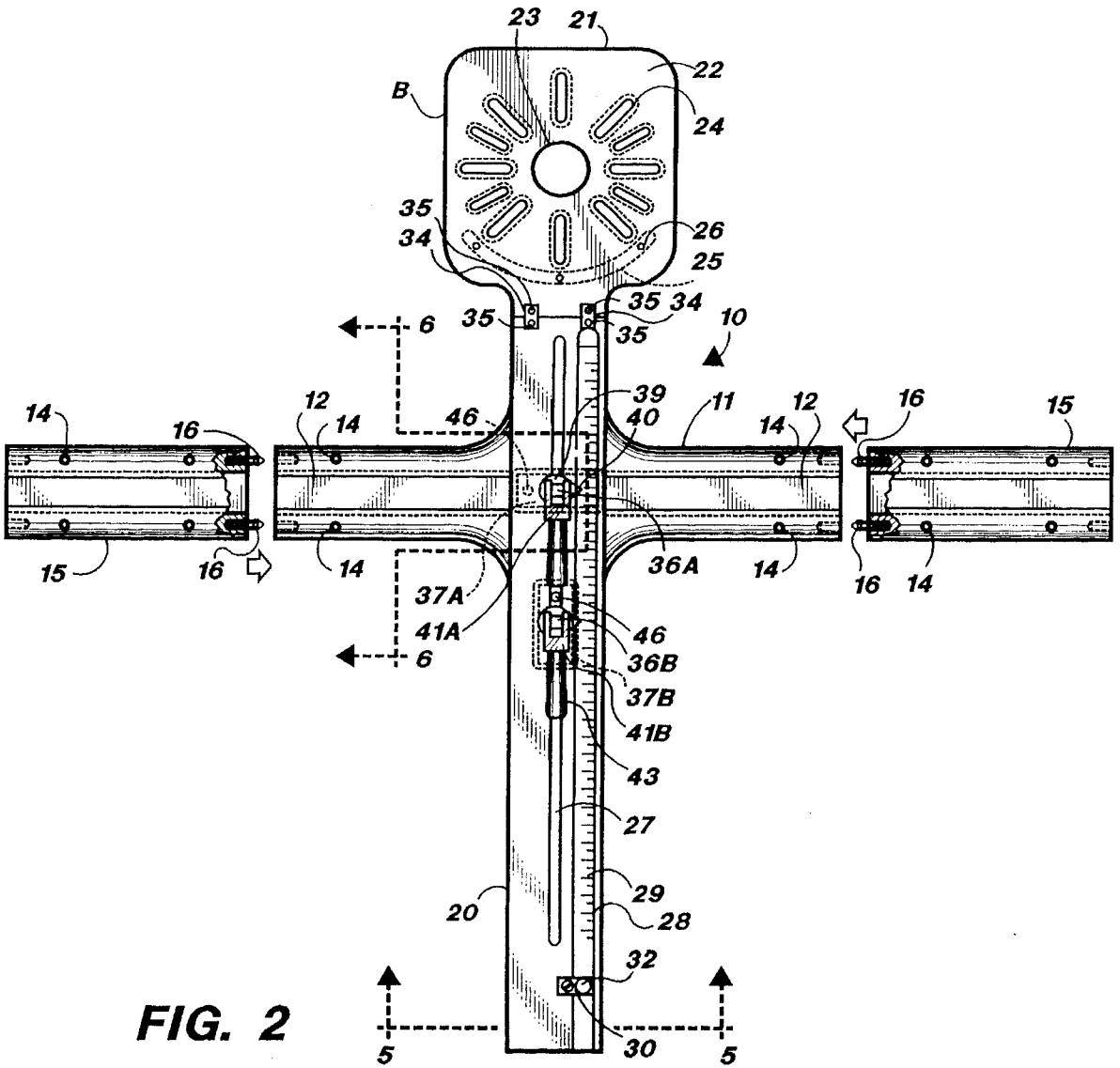
FIG. 2 is a top plan view of the ellipse scribe of FIG. 1 with the scribe arm shown at position B.
Figure 3:
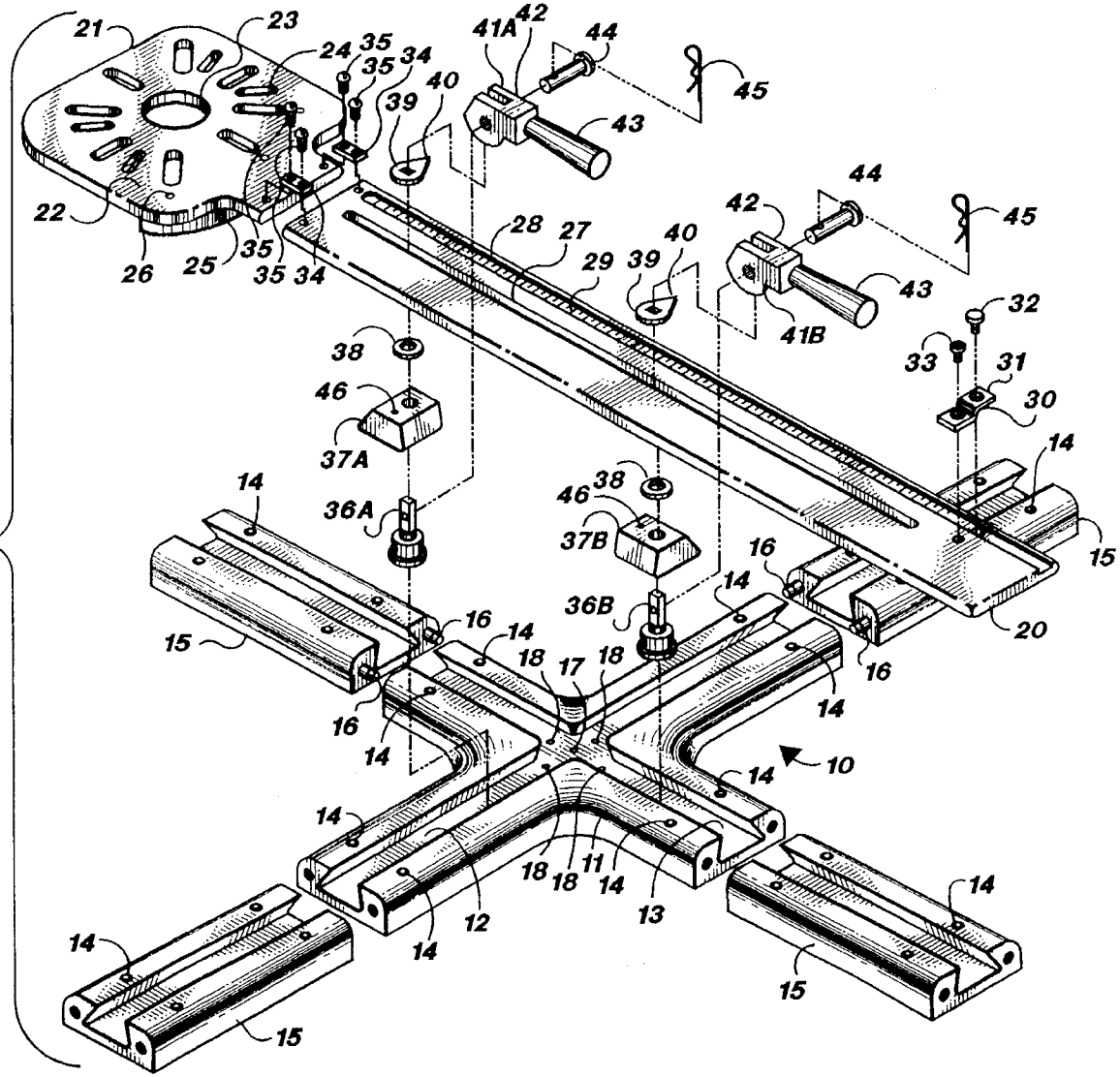
FIG. 3 is an exploded perspective view of the ellipse scribe of FIG. 1.
Figure 4:
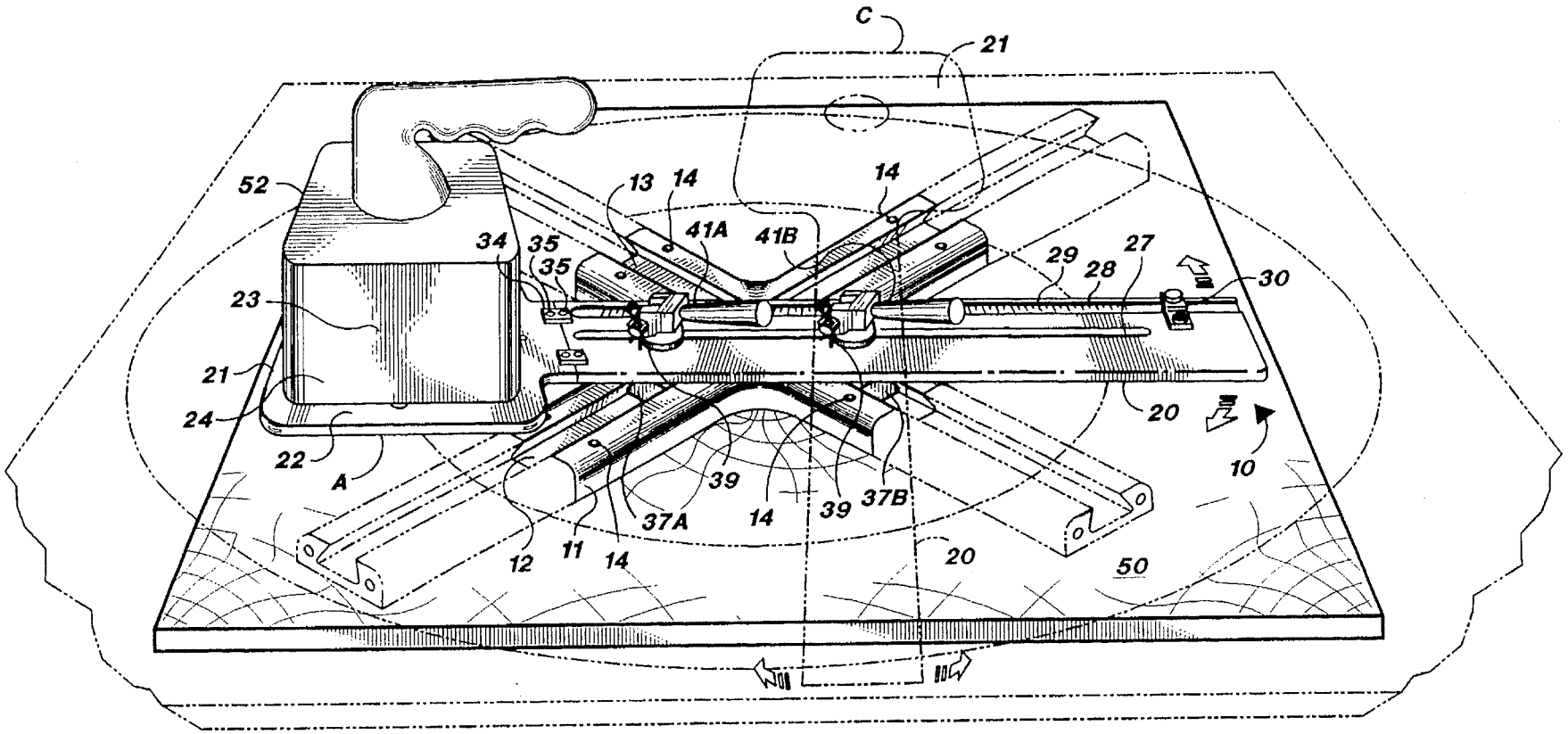
FIG. 4 is a perspective view of the ellipse scribe of FIG. 1 shown resting atop a workpiece.
Figure 8:
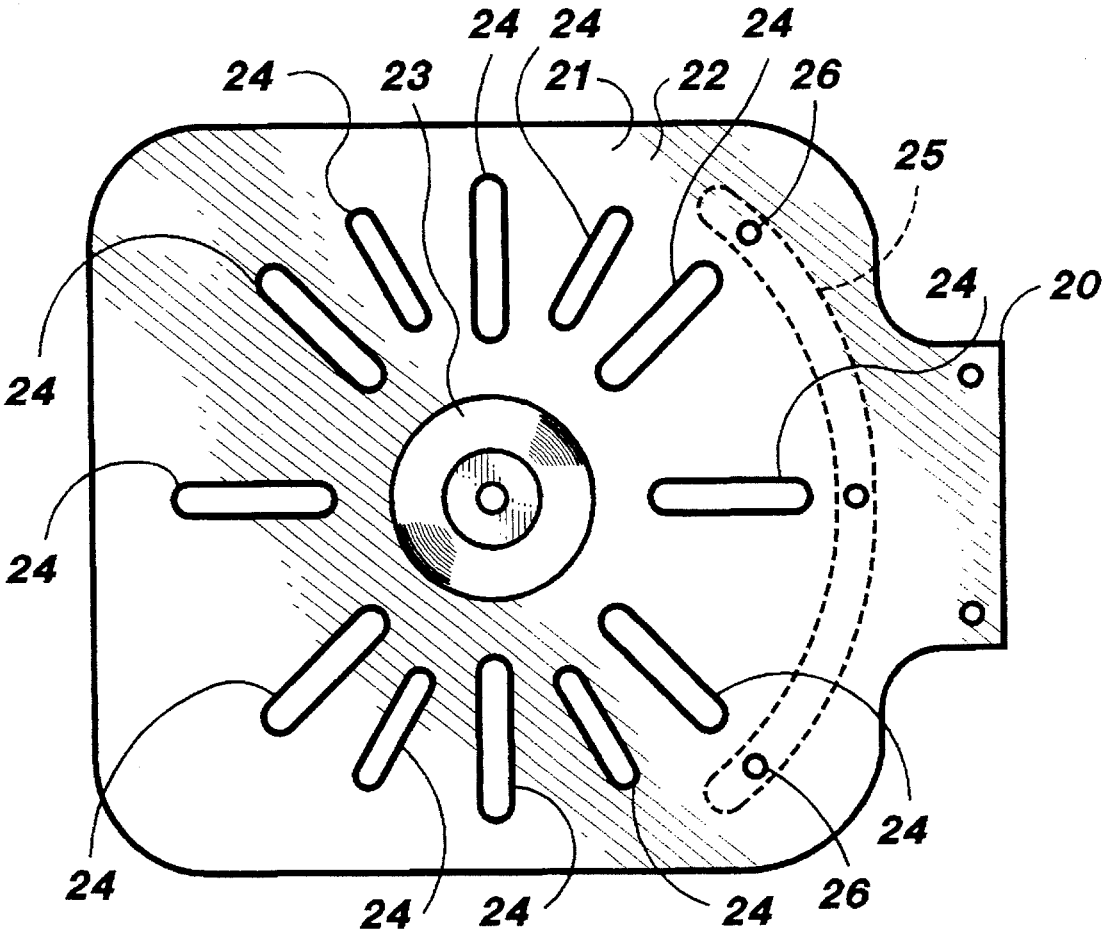
FIG. 8 is a top elevational view of the scribe end of the scribe beam of FIG. 1.
Figure 9:
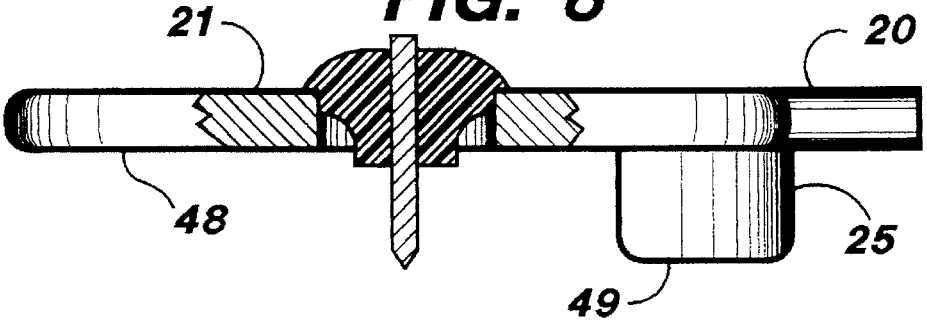
FIG. 9 is a partial cross-sectional view of the scribe end of the scribe beam of FIG. 6.

In the drawings, wherein the same or similar features are designated by the same reference number, the ellipse scribe of the present invention is shown generally at 10. Reference should be made particularly to FIGS. 1–4, which provide different views of the ellipse scribe 10 overall. The two main components of the ellipse scribe 10 are a track member 11, within which a first track 12 and a second track 13 rest, and a scribe beam 20, upon which a cursor may rest at a scribe end 21 so that it is oriented towards the workpiece. A cursor in the form of a router 52 for cutting is shown in FIG. 4, and a cursor in the form of a pencil, pen, or similar writing means is shown in FIGS. 8 and 9.

The scribe beam 20 is preferably made of a material with high strength and a high modulus of elasticity so that the scribe beam 20 resists bending and buckling while in use. The preferred embodiment of the ellipse scribe 20 uses a scribe beam 20 made of aluminum, though the scribe beam 20 may as easily be made of steel or other metal, plastic, or ceramic materials.

While the track member 11 may similarly be made of practically any metal, plastic, or ceramic material, it is preferably made of a material with high strength and a low coefficient of friction. The track member 11 of the preferred embodiment of the ellipse scribe 10 is made of ultra high molecular weight polyethylene. Other materials with a low coefficient of friction, such as teflon, also function well.

The first track 12 and the second track 13 comprise dovetail keyways which are set into the track member 11. The first and second tracks 12 and 13 are substantially perpendicular to one another, and they meet in the center of the track member 11 at a centerpoint 17. The first and second tracks 12 and 13 may include block anchor apertures 18 at different points throughout their length, and preferably near the centerpoint 17.

One function of the block anchor apertures 18 is to allow the craftsman to properly locate the ellipse scribe 10 atop the workpiece so that the ellipse is scribed in the intended location. Generally, the track member 11 is placed atop the workpiece 50 with the centerpoint 17 near the intended center of the ellipse. If the center of the ellipse must be very accurately located, the center of the intended ellipse may be marked upon the workpiece 50, and the block anchor apertures 18 may be used to spot the center mark even though the track member 11 rests atop the workpiece 50.

Figure 5:
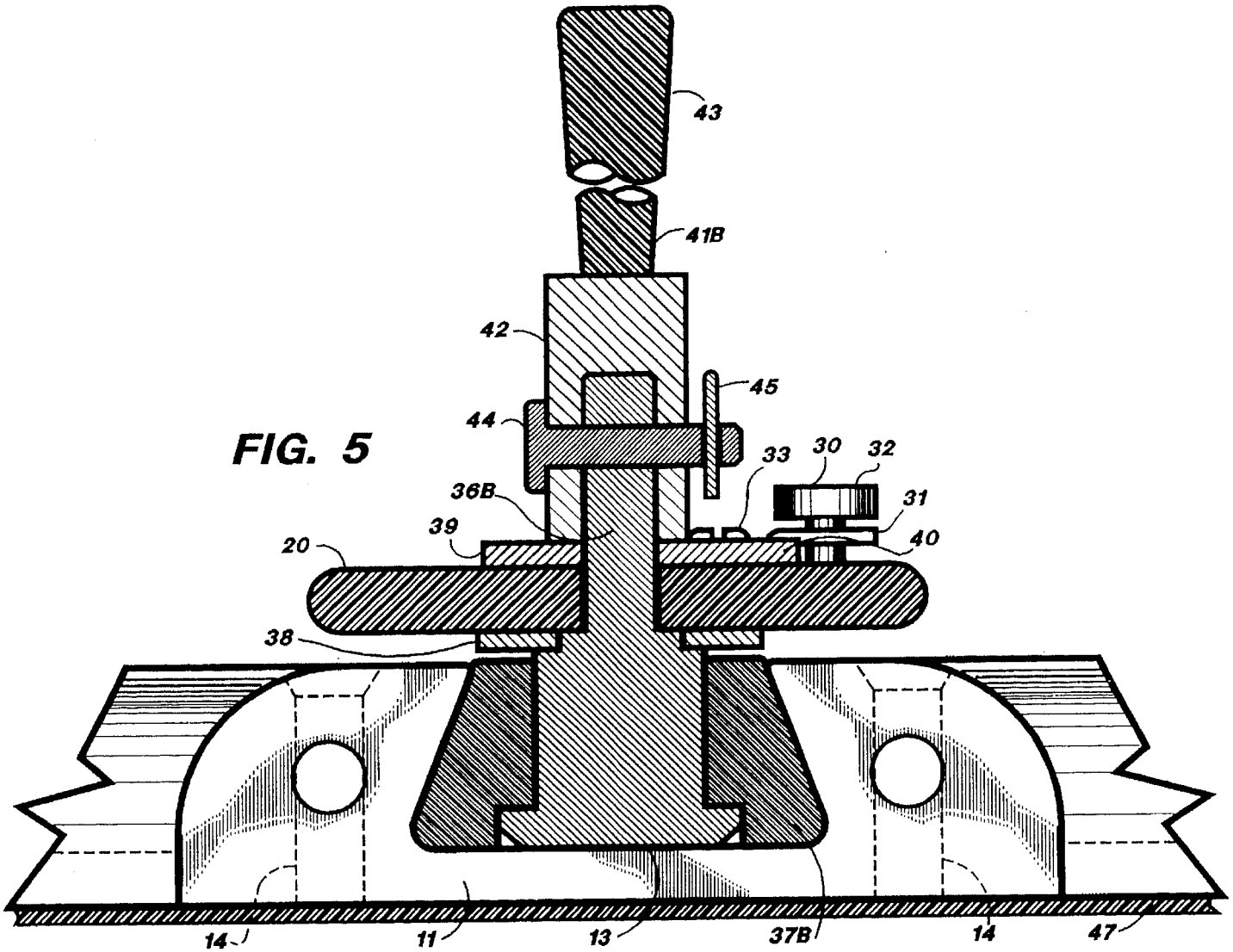
FIG. 5 is a cross-sectional view of the ellipse scribe of FIG. 2 taken along line 5—5 of FIG. 2.
Figure 7:
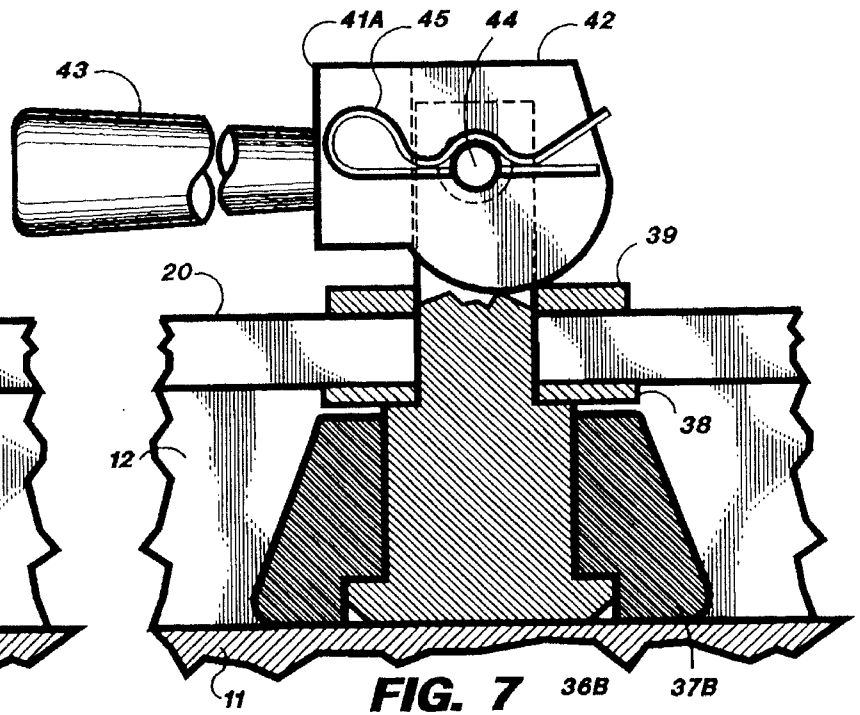
FIG. 7 is a cross-sectional view of the ellipse scribe of FIG. 2 taken along line 6—6 of FIG. 2, with the lever rotated 90° from the position shown in FIG. 6.
Figure 6:
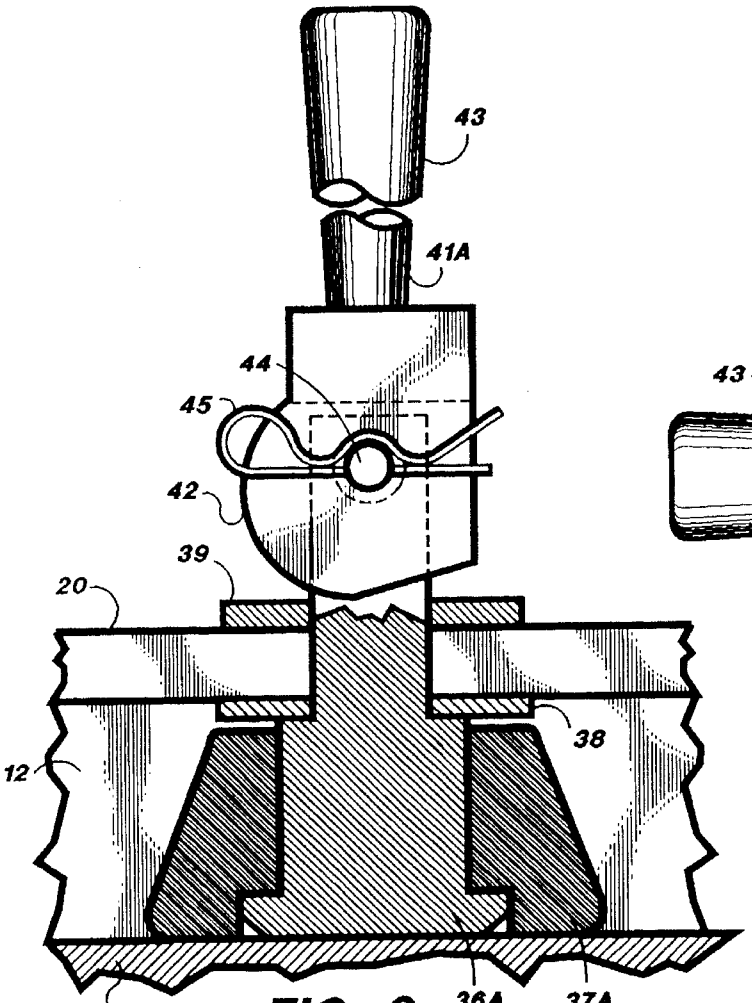
FIG. 6 is a cross-sectional view of the ellipse scribe of FIG. 2 taken along line 6—6 of FIG. 2.

The track member 11 may also include track mounting apertures 14 so that fasteners, such as screws, may be inserted therein and into the workpiece 50 so that the track member 11 does not slip as the ellipse scribe 10 draws the ellipse. The track member 11 may alternatively (or also) include nonslip means for nonintrusively affixing the track member 11 to the workpiece 50. Such nonslip means could take the form of knurling or roughening the base of the track member 11, or attaching a rubber or rough fabric mat thereto as shown at 47 in FIG. 5, so that the track member 11 will resist sliding across the workpiece 50.

Each of the first track 12 and the second track 13 have respective adjustment pins 36, more specifically **36*a* and 36*b*. Each adjustment pin 36*a* and 36*b* is rotatably and slidably affixed to its respective track 12 or 13. The first track 12 and the second track 13 also each include a slider block 37, slider blocks 37*a* and 37*b* respectively, each of which is adapted to fit closely within the tracks 12 and 13 and freely slide within. The first track 12 and the second track 13 comprise dovetail keyways cut into the track member 11, and the slider blocks 37 are shaped complementarily. The slider blocks 37 are preferably made of a high-strength material with a low coefficient of friction so that they may easily slide within the track member 11. In the preferred embodiment of the ellipse scribe 10, the slider blocks 37, like the track member 11, are made of ultra high molecular weight polyethylene. The use of this material allows a very high-tolerance fit between the slider blocks 37 and track member 11, but still allows the slider blocks 37 to slide within the track member 11** with a low-friction gliding motion.

However, despite the suitability of ultra high molecular weight polyethylene for the slider block 37 and track member 11 material, other plastic, metal, or ceramic materials may also function as the material for slider blocks 37. Additionally, the slider block 37 and track member 11 need not be made of the same material.

Each adjustment pin **36*a* or 36*b* is rotatably affixed to its respective slider block 37*a* or 37*b*. Thus, the adjustment pin 36 and slider block 37 arrangement allows rotational and translational motion of the adjustment pins 36*a* and 36*b* through the first and second tracks 12 and 13, thereby allowing the adjustment pins 36*a* and 36*b* to pivot as the slider blocks 37*a* and 37*b*** translate through the tracks.

While the preferred embodiment of the ellipse scribe 10 utilizes a first track 12 and second track 13 which comprise dovetail keyways cut into the track member 11, it is also possible that the first and second tracks 12 and 13 could comprise keyways of other shapes. The first track 12 and second track 13 could also comprise slots or elongated apertures within the track member 11. In any of these cases, the slider blocks **37*a* and 37*b* could be reshaped (or eliminated) accordingly. However, it has been found that the design of the preferred embodiment provides exceptionally smooth motion of the scribe beam 20 about the track member 11, and also that it provides greater resistance to vibrational and shear forces than the designs of the prior art. The slider blocks 37*a* and 37*b* are extremely difficult to dislodge from the keyways of the first and second tracks 12 and 13 or break regardless of whether a cutting tool at the scribe end 21 vibrates or jars the scribe beam 20. As noted above, the adjustment pins 36*a* and 36*b* may rotate and translate within the tracks 12 and 13. This allows the scribe beam 20 to be moved so that the adjustment pins 36*a* and 36*b* reciprocate through the first and second tracks 12 and 13 and sweep the scribe beam 20 about an elliptical path. As an illustration, the scribe end 21 of the scribe beam 20 may be moved from position A in FIG. 1, to position B in FIG. 2, then to position C in FIG. 4, and so on in a clockwise direction until the scribe end 21 returns to position A. When the scribe end 21 travels this route, it traces out an elliptical path, as do all other points along the scribe beam 20. Thus, a cursor (not shown) at the scribe end 21 can be used to trace out an ellipse onto the workpiece 50. The same ellipse is traced out if the scribe beam 20** travels in a counterclockwise direction from C to B to A.

The adjustment pins **36*a* and 36*b* are slidably affixed to the scribe beam 20 by means of the adjustment track 27, through which each adjustment pin 36*a* and 36*b* may translate. This allows a craftsman to relocate the adjustment pins 36*a* and 36*b* within the adjustment track 27 to change the size of the ellipse, as will be discussed below. However, a lever 41*a* or 41*b* may be engaged so that its respective adjustment pin 36*a* or 36*b* is not allowed to translate along the scribe beam 20, thereby preventing the size of the ellipse from changing. When engaged, the lever 41*a* or 41*b* affixes its respective adjustment pin 36*a* or 36*b* to the scribe beam 20 so that it cannot move within the adjustment track 27. The levers 41*a* and 41*b*** will also be discussed in greater length below.

The size of the ellipse to be scribed is determined by the location of the adjustment pins **36*a* and 36*b* in relation to a cursor, which is intended to rest within the cursor aperture 23. (As will be discussed shortly, the cursor is a cutting tool, as in FIG. 4, or a writing tool, as in FIGS. 8 and 9.) The orientation of the major axis of the ellipse corresponds to the track containing the adjustment pin 36 which is nearest to the cursor, and its size depends on the distance between the cursor and the adjustment pin farthest from the cursor. Similarly, the orientation of the minor axis of the ellipse corresponds to the track containing the adjustment pin 36 which is farthest from the cursor, and its size depends on the distance between the cursor and the adjustment pin nearest to the cursor. Thus, the ellipse scribe 10 shown in the figures has a major axis direction corresponding to the first track 12 and a minor axis direction corresponding to the second track 13. In addition, the major axis radius of the ellipse is equal to the distance between the cursor and the adjustment pin 36***b*, and the minor axis radius is equal to the distance between the cursor and the adjustment pin 36*a*. By relocating the adjustment pins 36 within the adjustment track 27, the major and minor axis radii of the ellipse can be changed as desired.

In the preferred embodiment of the invention, unless the adjustment pins 36*a* and 36*b* are reversed so that pin 36*a* is farther from the cursor than pin 36*b*, the same tracks 12 and 13 will always serve as the same major and minor axes of the ellipse. It is therefore helpful if the first track 12 and second track 13 each bear a label stating whether they correspond to a major or minor axis; for example, the first track 12 could bear a label "Major" or the like, and the second track 13 could bear a label "Minor". This avoids the confusion that novices typically experience when they initially try to discern the operation of an ellipse scribe 10. However, the fixing of the major and minor axes within to specific tracks 12 and 13 within the ellipse scribe 10 does carry one drawback: during ordinary operation, the ellipse scribe 10 of the present invention can only inscribe ellipses, and never circles. A circle can only be scribed when the adjustment pins 36*a* and 36*b* are located the same distance from the cursor. Since the adjustment pins 36 cannot rest atop each other within the adjustment track 27, the ellipse scribe 10 depicted in the figures is incapable of scribing a circle during ordinary operation. However, as will be discussed shortly, the ellipse scribe 10 can be modified to scribe a circle.

As previously mentioned, the ellipse scribe 10 will always scribe an ellipse having a major axis corresponding to the first track 12, and a minor axis corresponding to the second track 13, unless the adjustment pins 36 are reversed. Similarly, unless the pins 36 are reversed, the location of each adjustment pin 36*a* and 36*b* along the scribe beam 20 will always determine the size of the same major or minor radius/diameter. Thus, the adjustment pins 36*a* and 36*b* (or their respective indicator washers 39, etc.) may bear indicia indicating which axis each adjustment pin 36*a* and 36*b* corresponds to, e.g. a "major" label for the adjustment pin 36*b* and a "minor" label for the adjustment pin 36*a*. Alternatively, the first and second tracks 12 and 13, which correspond to the major and minor axes, may be differently colored and each adjustment pin 36*a* and 36*b* may be color-coded to match its corresponding track. Such labeling or color-coding enables novice users to quickly and easily discern whether they have set an adjustment pin 36 to achieve a desired major or minor axis measurement.

If the craftsman desires, the ellipse scribe 10 can be modified to scribe a circle. First, the craftsman must remove a bridge pin 45 at adjustment pin 36*a* and disassemble this adjustment pin 36*a* assembly, sliding its slider block 37*a* out of the track member 11 and removing its adjustment pin 36*a*, slider block 37*a*, shim washer 38, indicator washer 39 and lever 41*a* from the ellipse scribe 10. Second, the craftsman must anchor the remaining slider block 37*b* so that the scribe beam 20 can only rotate about the adjustment pin 36*b*. The slider block 37*b* comains an anchor hole 46. The remaining slider block 37*b* may be positioned in a track 12 or 13 so that its anchor hole 46 is coincident with a block anchor aperture 18. An anchor pin (not shown), which is merely a dowel sized to accommodate both the anchor hole 46 and one of the block anchor apertures 18, may be inserted within these apertures so that the slider block 37*b* cannot translate within the track 12 or 13. When the remaining lever 41*b* is engaged, the scribe beam 20 is anchored to the adjustment pin 36*b* so that it may only rotate with the adjustment pin 36*b* within the anchored slider block 37*b*, and the cursor may only scribe out a circle. While this process is described with reference to the removal of the adjustment pin 36*a*/slider block 37*a* assembly and the anchoring of the adjustment pin 36*b*/slider block 37*b* assembly, the same results are achieved if the adjustment pin 36*b*/slider block 37*b* assembly is removed and the adjustment pin 36*a*/slider block 37*a* assembly is anchored.

To summarize, the size of the ellipse to be scribed may be easily set and reset by repositioning the adjustment pins 36*a* and 36*b* within the adjustment track 27, which is cut into the length of the scribe beam 20. The adjustment pins 36*a* and 36*b* extend through this adjustment track 27 and may translate within the adjustment track 27 when their respective levers 41*a* and 41*b* are not engaged. The size of the ellipse is reset by translating the adjustment pins 36*a* and 36*b* within the adjustment track 27 until the distance between each adjustment pin 36*a* and 36*b* and the cursor is set as desired. The levers 41*a* and 41*b* can then be engaged so that each adjustment pin 36*a* and 36*b* may no longer translate along the scribe beam 20, thereby fixing the size of the ellipse.

The levers 41*a* and 41*b* are designed to strongly resist slippage of the adjustment pins 36*a* and 36*b* in relation to the scribe beam 20, thereby preventing the size of the ellipse from changing even when the scribe beam 20 is subjected to vibrational and shear forces from cutting tools at the scribe end 21. The levers 41*a* and 41*b* each include a lever handle 43 and a spiral cam lock clevis 42. The spiral cam lock clevis 42 rotates about the adjustment pin 36*a* or 36*b* at a clevis pin 44, which is affixed to the lever 41*a* or 41*b* by means of a bridge pin 45. As the spiral cam lock clevis 42 is rotated about the clevis pin 44, so that its lever handle 43 rests parallel to the plane of the workpiece 50, its diameter increases with respect to an indicator washer 39 and it exerts a compressive force thereupon. The indicator washer 39 thereby becomes affixed to the scribe beam 20. The indicator washer 39 then presses the scribe beam 20 tightly against the shim washer 38 and the adjustment pins 36*a* and 36*b*, thereby preventing the respective adjustment pin 36*a* or 36*b* from translating in the adjustment track 27.

While the preferred embodiment of the ellipse scribe 10 utilizes the lever 41*a* and 41*b* arrangement as the fixture means for transitionally affixing the adjustment pins 36*a* and 36*b* to the scribe beam 20, other types of fixture means are possible. For example, the ends of the adjustment pins 36*a* and 36*b* could be threaded, and a knob could be screwed thereupon until it sandwiches the scribe beam 20 between the indicator washer 39 and shim washer 38 in much the same manner that the spiral cam lock clevis 42 does. However, the lever 41*a* and 41*b* arrangement has been found to be particularly effective in resisting shear and vibrational forces and keeping the adjustment pins 36*a* and 36*b* firmly anchored from translating along the adjustment track 27 when a cutting tool is used in combination with the ellipse scribe 10.

A scale 29 rests on the scribe beam 20 adjacent to the adjustment track 27. The scale 29 indicates the distance of each adjustment pin 36*a* and 36*b* from the cursor and thereby indicates the sizes of the major and minor axes of the ellipse. Its markings may be calibrated so that the distance between the cursor (at the center of the cursor aperture 23) and the adjustment pins 36*a* and 36*b* may be easily discerned. A point 40 located upon each indicator washer 39 serves to precisely indicate the location of the adjustment pins 36*a* and 36*b* along the scale 29.

In the preferred embodiment of the ellipse scribe 10, the scale 29 is removably inserted within the scribe beam 20 by means of a scale slot 28, a t-slot cut into the surface of the scribe beam 20. Thus, the scale 29 may be replaced with other scales 29 with different measurement systems (e.g. English or metric), which are calibrated to indicate either the ellipse radii or diameters. A craftsman may also insert a customized scale containing indicia representing commonly used measurements. For example, if a craftsman repeatedly cuts only three certain sizes of ellipses, he may insert a scale 29 which has indicia that show only the dimensions for these ellipses. This would allow the craftsman to very quickly reset the adjustment pins 36*a* and 36*b* to the three commonly used sets of scale 29 locations.

The scale 29 may be affixed to the scribe beam 20 by means of a scale locking assembly 30. In the preferred embodiment of the invention, the scale locking assembly 30 comprises a standoff 31 affixed to the scribe beam 20 by means of a fixture screw 33. A releasable thumb screw 32 extends through the standoff 31 and holds the scale 29 within the scale slot 28. Thus, not only may the scale 29 be removed, but it may be repositioned within the scale slot 28 to adjust the scale with respect to the cursor and adjustment pins 36*a* and 36*b* as desired. This is helpful when the craftsman wants to calibrate the scale to compensate for the size of the cutterhead. For example, the craftsman may want to measure the diameters/radii for a cut ellipse with respect to either the inside or the outside of a router bit. A scale 29 which is permanently affixed to the scribe beam 20 could also be provided.

The ellipse scribe 10 of the present invention is preferably able to scribe a great variety of sizes of ellipses. For this purpose, it is desirable that the track member 11 be constructed in modular fashion so that the first track 12 and second track 13 may be increased in length as desired. Track extension modules 15, which are preferably identical and interchangeable, are provided with dowel pins 16 which may engage the track member 11 to extend the first track 12 and/or the second track 13. Removable track extension modules 15 are also helpful when one axis of the ellipse (and thus one track of the ellipse scribe 10) must be of such a length that the cursor at the scribe end 21 will interfere with it when the cursor passes over it. The track extension module 15 may simply be removed when the scribe end 21 needs to cross the track, and then replaced after the scribe end 21 has passed.

The scribe beam 20 also includes a detachable scribe end 21, which is attached to the scribe beam 20 by means of locator tabs 34 and set screws 35. The detachable scribe end 21 allows the scribe beam 20 to be detached from the scribe end 21 and replaced by a scribe beam 20 of greater length if a longer scribe beam 20 is needed for scribing larger ellipses. A cast aluminum scribe end 21 has been found to function well during the operation of the ellipse scribe 10, though other metals, ceramics, and plastics may be manufactured by other methods to produce a working scribe end 21.

A cursor located within a cursor aperture 23 at the scribe end 21 of the scribe beam 20 will mark or cut the ellipse into a workpiece 50 located below the ellipse scribe 10. The cursor may comprise a writing tool such as a pencil, pen, or woodburning tool, as shown in FIGS. 8 and 9, or a cutting tool such as a saw or a router, as shown at 52 in FIG. 4. The working portion of the cursor tool may extend through the cursor aperture 23 of the scribe end 21, which corresponds to the cursor point, to reach the workpiece 50 beneath. A mounting plate 22 at the scribe end is provided to allow heavy (or light) marking or cutting tools to be affixed to the scribe beam 20. The cursor tool may be fastened to the mounting plate 22 by use of the affixment apertures 24, which are organized into the universal mounting pattern. Alternatively, rubber plugs or the like with central apertures may be force-fit within the cursor aperture 23, and drawing tools may then be force-fit within the central aperture, as shown in FIGS. 8 and 9. Other means for attaching writing or cutting tools to the scribe end 21 will be apparent to those skilled in the art.

If the cursor is an exceptionally heavy tool, a reinforced scribe end support 25 may be provided on the underside 48 of the mounting plate 22 and attached thereto by means of fasteners extending through arm anchor apertures 26. The vertical height of the reinforced scribe end support 25 is preferably equal to the distance from the underside 48 of the mounting plate 22 to the top of the workpiece 50. The reinforced scribe end support 25 will thereby prevent the scribe beam 20 from buckling and bending downward at the scribe end 21 when a heavy cursor tool is placed atop the scribe end 21. Additionally, the reinforced scribe end support 25 preferably has a smooth, hard, low-friction lower surface 49. This allows the scribe beam 20 to rotate about an elliptical path with the lower surface 49 of the reinforced scribe end support 25 sliding, rather than scraping, over the top surface of the workpiece 50. The reinforced scribe end support 25 has been found to function well when made of cast aluminum.

It is understood that the invention is not confined to the particular construction and arrangement of parts herein illustrated and described, but embraces such modified forms thereof as come within the scope of the following claims.

What is claimed is:

1. A contact beam ellipse scribe apparatus comprising:

a. a first track including a block aperture therein;

b. a second track oriented perpendicularly to the first track and intersecting the first track at a centerpoint;

c. a scribe beam including an elongated beam element with a scribe end and an adjustment track located on and substantially parallel to the elongated beam element;

d. a first slider block slidably engaged within the first track and including an anchor hole therein, wherein the first slider block may be slidably located within the first track so that the anchor hole and block anchor aperture may be collinearly aligned;

e. a first adjustment pin which rotatably engages the first slider block;

f. a second slider block slidably engaged within the second track, wherein the first track and the second track each comprise keyways in which the first slider block and the second slider block are respectively adapted to slidably fit; and g. a second adjustment pin which rotatably engages the second slider block;

h. an anchor pin sized to be inserted within both the anchor hole and the block anchor aperture when the anchor hole and the block anchor aperture are collinearly aligned.

2. The apparatus of claim 1 wherein the keyway is a dovetail keyway.

3. The apparatus of claim 1 wherein the scribe beam includes scale means for indicating a scaled distance from the scribe end to the scale means.

4. The apparatus of claim 1 wherein at least one of the first adjustment pin and the second adjustment pin includes fixture means for respectively affixing the first adjustment pin and the second adjustment pin to the scribe beam.

5. The apparatus of claim 4 wherein the fixture means comprise a lever hingably attached to said at least one of the first adjustment pin and the second adjustment pin.

6. The apparatus of claim 5 wherein the lever includes a lever handle extending from a spiral cam clevis which is adapted so that when the lever handle is actuated, the spiral cam clevis engages the adjustment pin to the scribe beam in such a manner that the adjustment pin may not translate with respect to the scribe beam.

7. The apparatus of claim 1 wherein at least one of the first track and the second track is of modular construction.

8. The apparatus of claim 1 wherein the scribe end includes a support means for supporting a tool.

9. The apparatus of claim 8 wherein the support means comprises a mounting plate, a cursor aperture extending through the mounting plate for placement of a tool within, and a plurality of affixment apertures extending through the mounting plate and distributed about the cursor aperture for mounting the tool to the mounting plate.

10. The apparatus of claim 1 wherein the scribe end is detachable from the scribe beam.

11. The apparatus of claim 1 wherein the centerpoint includes an aperture for locating the center of the ellipse.

12. The apparatus of claim 1 wherein at least one of the first track and the second track includes nonslip means for affixing the first track and the second track to a workpiece.

13. The apparatus of claim 1 in combination with a writing tool removably attached to the scribe end.

14. The apparatus of claim 1 in combination with a cutting tool removably attached to the scribe end.

15. The apparatus of claim 14 wherein the cutting tool comprises a router.

16. The apparatus of claim 1 in combination with a reinforced scribe end support releasibly attached to the scribe end, the support having a height extending between the scribe end and the workpiece so as to support the scribe end above the workpiece.

17. A contact beam ellipse scribe apparatus comprising:

a. a first track including a block anchor aperture therein;

b. a second track oriented perpendicularly to the first track and intersecting the first track at a centerpoint;

c. a first slider block slidably engaging the first track and including an anchor hole therein, wherein the first slider block may be slidably located within the first track so that the anchor hole is collinearly aligned with the block anchor aperture;

d. a second slider block slidably engaging the second track;

e. a scribe beam including an elongated beam element with a scribe end and an adjustment track located on and parallel to the elongated beam element;

f. a first adjustment pin rotatably connected to the first slider block and located within the adjustment track so as to be slidably connected to the scribe beam;

g. first fixture means for affixing the first adjustment pin to the scribe beam in such a manner as to prevent sliding of the first adjustment pin with respect to the scribe beam;

h. a second adjustment pin rotatably connected to the second slider block and located within the adjustment track so as to be slidably connected to the scribe beam; and i. second fixture means for affixing the second adjustment pin to the scribe beam in such a manner as to prevent sliding of the second adjustment pin with respect to the scribe beam;

j. an anchor pin sized to be inserted within both the anchor hole and the block anchor aperture when the anchor hole and the block anchor aperture are collinearly aligned.

18. The apparatus of claim 17 wherein the first track and second track comprise dovetail keyways wherein the first and second slider blocks rest.

19. The apparatus of claim 17 wherein the first fixture means and second fixture means each comprise a spiral cam clevis hingably attached to the first and second adjustment pins.

20. The apparatus of claim 17 wherein the scribe end comprises a mounting plate which is removable from the scribe beam, a cursor aperture extending through the mounting plate for placement of a tool within, and a plurality of affixment apertures extending through the mounting plate and distributed about the cursor aperture for mounting the tool to the mounting plate.

* * * * *